US006922961B2

(12) United States Patent
Wright

(10) Patent No.: US 6,922,961 B2
(45) Date of Patent: Aug. 2, 2005

(54) VERTICAL AND HORIZONTAL SPACERS TO FORM CURVED GLASS BLOCK WALLS

(75) Inventor: Brian Wright, Snohomish, WA (US)

(73) Assignee: Seattle Glass Block, Woodinville, WA (US)

( * ) Notice: Subject to any disclaimer, the term of this patent is extended or adjusted under 35 U.S.C. 154(b) by 141 days.

(21) Appl. No.: 10/274,927

(22) Filed: Oct. 22, 2002

(65) Prior Publication Data

US 2004/0074179 A1 Apr. 22, 2004

(51) Int. Cl.[7] ..... E04C 1/42

(52) U.S. Cl. ..... 52/308; 52/601; 52/396.08; 52/442; 52/747.12; 446/111

(58) Field of Search ..... 52/306–308, 396.08, 52/601, 747.12, 745.11, 586.2, 442, 447, 477, 656.9; 446/111

(56) References Cited

U.S. PATENT DOCUMENTS

| | | | | | |
|---|---|---|---|---|---|
| 3,893,269 | A | * | 7/1975 | Nelsson et al. | 52/65 |
| 4,062,161 | A | * | 12/1977 | Schubach | 52/461 |
| 4,357,744 | A | * | 11/1982 | McKenzie et al. | 29/451 |
| 4,663,896 | A | * | 5/1987 | Dunnick | 52/71 |
| 5,031,372 | A | * | 7/1991 | McCluer | 52/307 |
| 5,042,210 | A | * | 8/1991 | Taylor | 52/307 |
| 5,259,164 | A | * | 11/1993 | Wiese | 52/578 |
| 5,430,985 | A | * | 7/1995 | Coleman | 52/308 |
| 5,485,702 | A | | 1/1996 | Sholton | |
| 5,640,818 | A | * | 6/1997 | Wirkus et al. | 52/306 |
| 5,655,345 | A | * | 8/1997 | Thompson | 52/396.1 |
| 5,704,177 | A | | 1/1998 | Wirkus et al. | |
| 5,878,802 | A | * | 3/1999 | Richter et al. | 52/285.1 |
| 5,907,937 | A | * | 6/1999 | Loftus et al. | 52/308 |
| 5,992,111 | A | | 11/1999 | Waterhouse | |
| 6,059,268 | A | * | 5/2000 | Santelli, Jr. | 52/102 |
| 6,325,694 | B1 | * | 12/2001 | Clever et al. | 446/104 |

FOREIGN PATENT DOCUMENTS

| | | | |
|---|---|---|---|
| JP | 2000-64457 | * | 2/2000 |

* cited by examiner

*Primary Examiner*—Winnie Yip
(74) *Attorney, Agent, or Firm*—Hall, Myers, Vande Sande & Pequignot

(57) ABSTRACT

This application discloses parts for use in constructing a curved glass block wall using regular shaped glass blocks. The assembly parts include a vertical spacer, which provides for adjustable widths of spacing to be obtained between adjacent glass blocks, as well as a horizontal connector which provides for both lateral and transverse adjustments to be made.

16 Claims, 5 Drawing Sheets

VERTICAL AND HORIZONTAL SPACERS TO FORM CURVED GLASS BLOCK WALLS

FIELD

The present invention relates to vertical spacers and horizontal connectors for use in spacing glass blocks to erect a curved wall formed from such blocks.

BACKGROUND OF THE INVENTION

Glass blocks are widely used in modern architecture and in the construction industry for building things such as walls, partitions and shower walls. The present invention is directed to construction of curved glass block walls formed with the use of regular glass blocks. Regular glass blocks have a generally rectangular configuration with a raised peripheral flange formed around the external faces of the block and an intermediate raised peripheral flange disposed proximate the midpoint of the internal periphery of the glass block.

When assembling a glass block wall with mortar a high degree of skill is required, as the weight of the blocks on the grout make it difficult to obtain evenly spaced horizontal or vertical course arrangements between each row of blocks. Also, the blocks tend to be non-porous and as a result do not form a strong bond with the mortar. In order to solve these problems, many glass block assemblies exist which use generally rigid spacing, reinforcement and tying devices for the blocks.

As a consequence, there is a need for a spacer system that not only enables the blocks to be easily adjusted, but also uses regular glass blocks to easily and quickly enable the formation of curved glass block walls. Accordingly, it is an object of the invention to provide adjustable vertical and horizontal curved glass block wall spacers for use with regular glass blocks.

SUMMARY OF THE INVENTION

The present invention provides a spacer assembly for use with regular glass blocks to form curved walls. The vertical spacer is positioned between the end walls of adjacent blocks and has the ability to provide variably sized joints with the same part. The vertical spacer member preferably has a length substantially equal to the height of the glass block.

The horizontal spacer is designed to provide lateral and transverse adjustability. The horizontal spacer preferably consists of two identical pieces. A rotatable coupling in the spacer provides transverse adjustment. One or more prongs projecting from opposite sides of the coupling provide lateral adjustment.

The combined use of the vertical spacer and horizontal connector enables a curved glass wall to be installed in a reduced amount of time and effort.

The invention further includes a method of assembling a glass block wall using the aforementioned vertical spacer and horizontal connector.

BRIEF DESCRIPTION OF THE DRAWINGS

Further features and advantages of the invention will be apparent from the following detailed description, given by way of example, of a preferred embodiment taken in conjunction with the accompanying drawings, wherein.

DETAILED DESCRIPTION OF THE INVENTION

Figure 1:
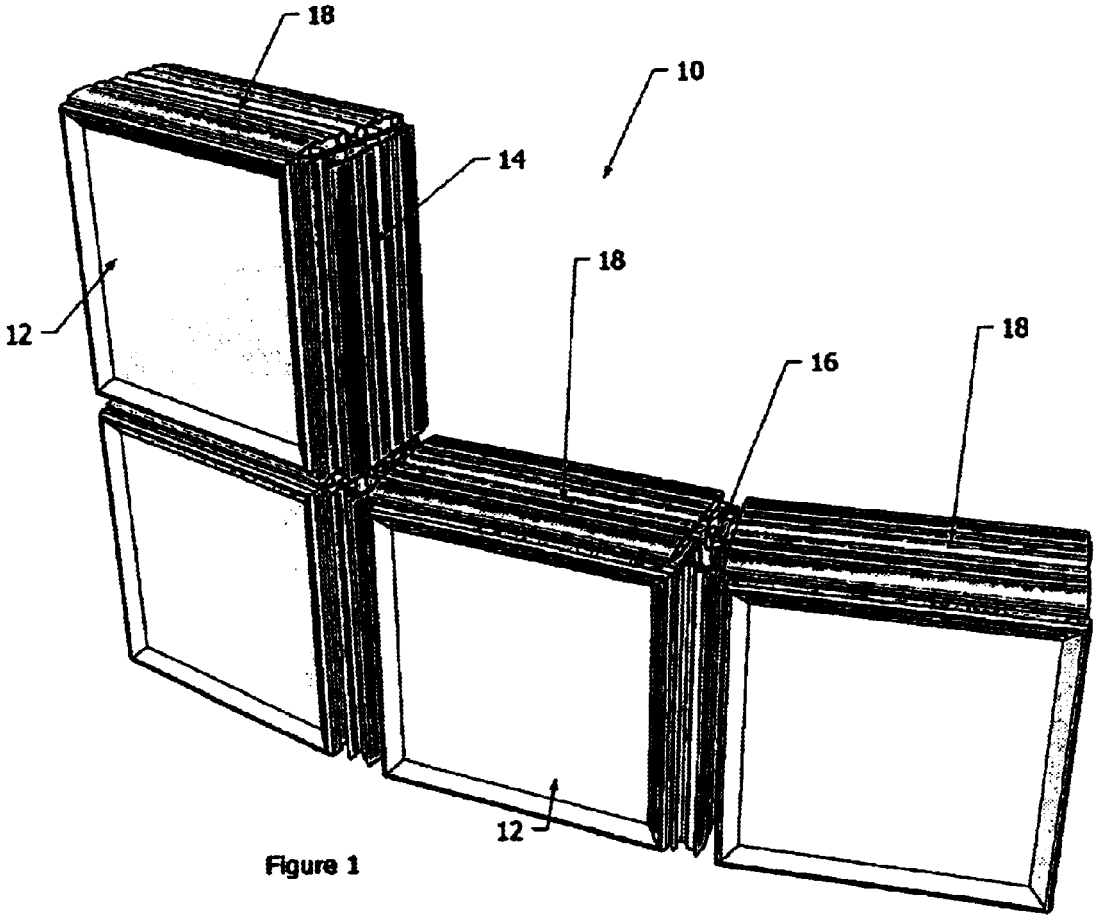
FIG. 1 is a perspective view of a section of glass block wall constructed in accordance with the teachings of this invention.

Referring to FIG. 1, the glass block wall that is constructed from this invention is designated by reference numeral 10. The wall 10, is constructed using glass blocks 12 in conjunction with the vertical spacers 14, horizontal connectors 16, and horizontal spacers 18.

The type of glass blocks 12 used have a generally rectangular configuration with a raised peripheral flange formed around the external faces of the block and an intermediate raised peripheral flange disposed proximate the midpoint of the internal periphery of the glass block. Regular glass blocks are available in various sizes from various commercial sources such as Pittsburgh-Corning Company.

Figure 2:
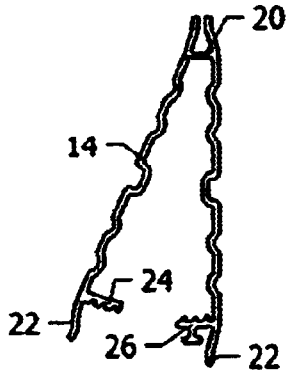
FIG. 2 is a top view of the vertical spacer.

Referring to FIG. 2 a top view of the vertical spacer 14 is illustrated. The vertical spacer 14 is formed from two planar pieces joined by a fixed width side 20 on one outer side and an adjustable width side 22 on the side opposite the fixed width side 20. The adjustable width side 22 comprises ridges and troughs 24 which connect to the ridges and troughs 26 to provide fixed variations of adjustable width.

Figures 3A, 3B, 3C:
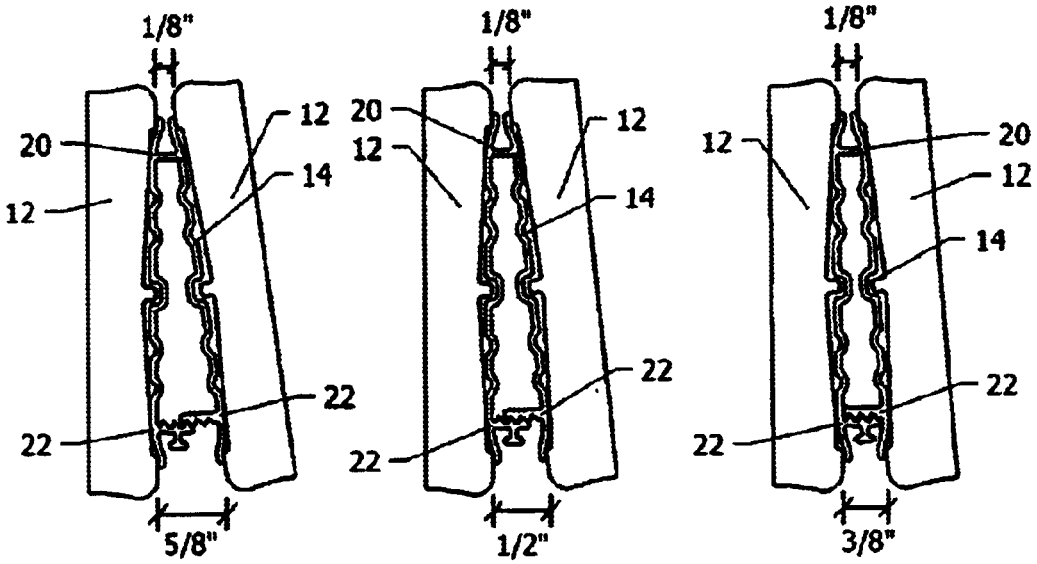
FIGS. 3A–C are top views of the vertical spacer illustrating the variable size.

Referring to FIGS. 3A–C a top view of the vertical spacer 12 is illustrated between adjacent glass blocks 12. Table 1 represents the widths provided for by the vertical spacer 12 in inches.

TABLE 1

Widths Provided by the Vertical Spacer

| | Fixed Width Side (inches) | Variable Width Side (inches) |
|---|---|---|
| FIG. 3A | ⅛ | ⅝ |
| FIG. 3B | ⅛ | ½ |
| FIG. 3C | ⅛ | ⅜ |

Although three troughs are illustrated, any number of troughs may be used to provide any number of variable widths. Further, any suitable adjustment means for providing a variable width may be used.

Figure 4:
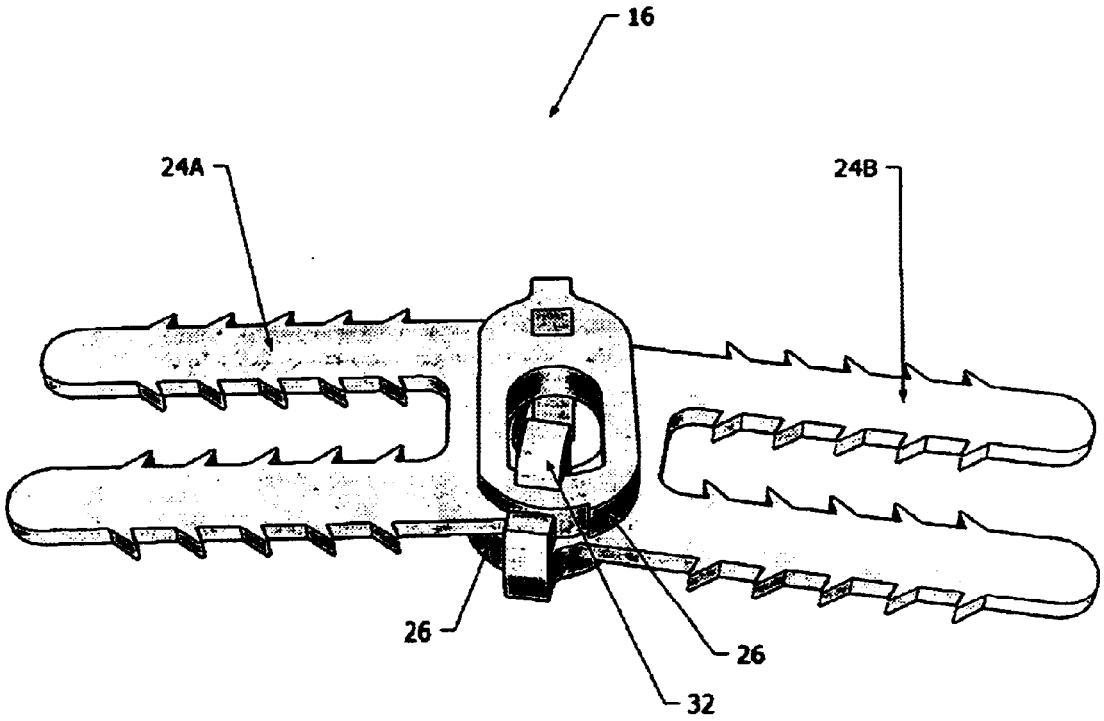
FIG. 4 is a perspective view of the horizontal spacer.
Figure 5:
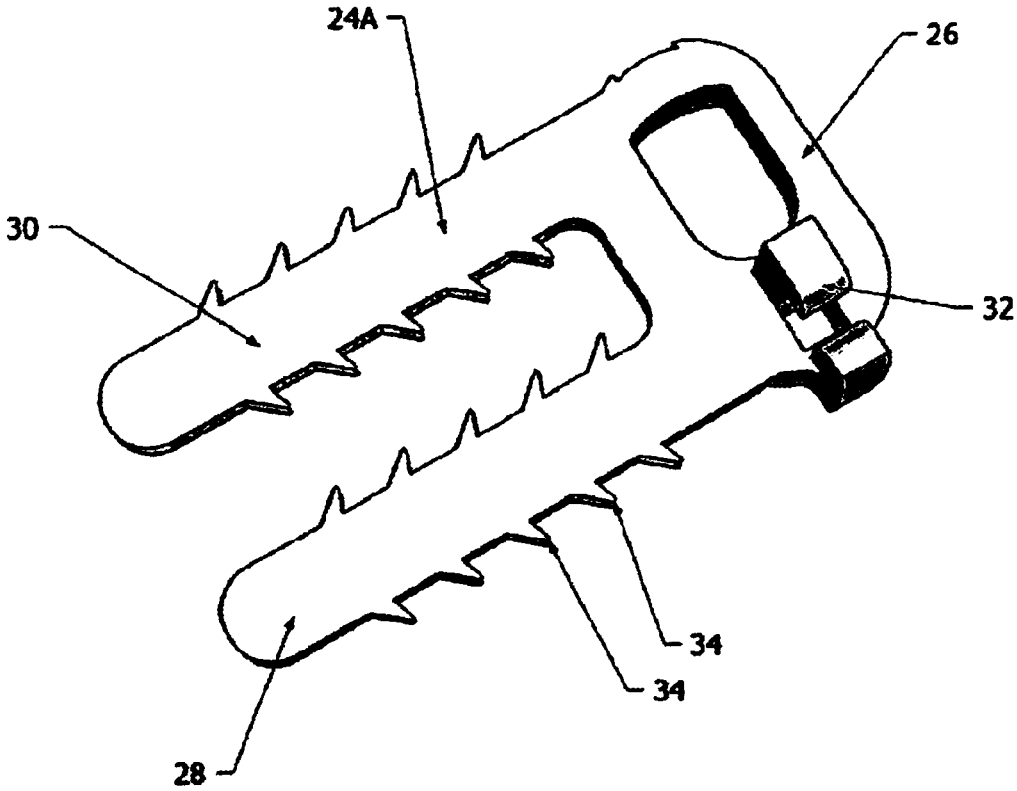
FIG. 5 is a perspective view of one of two identical pieces used in the horizontal spacer.
Figure 6:
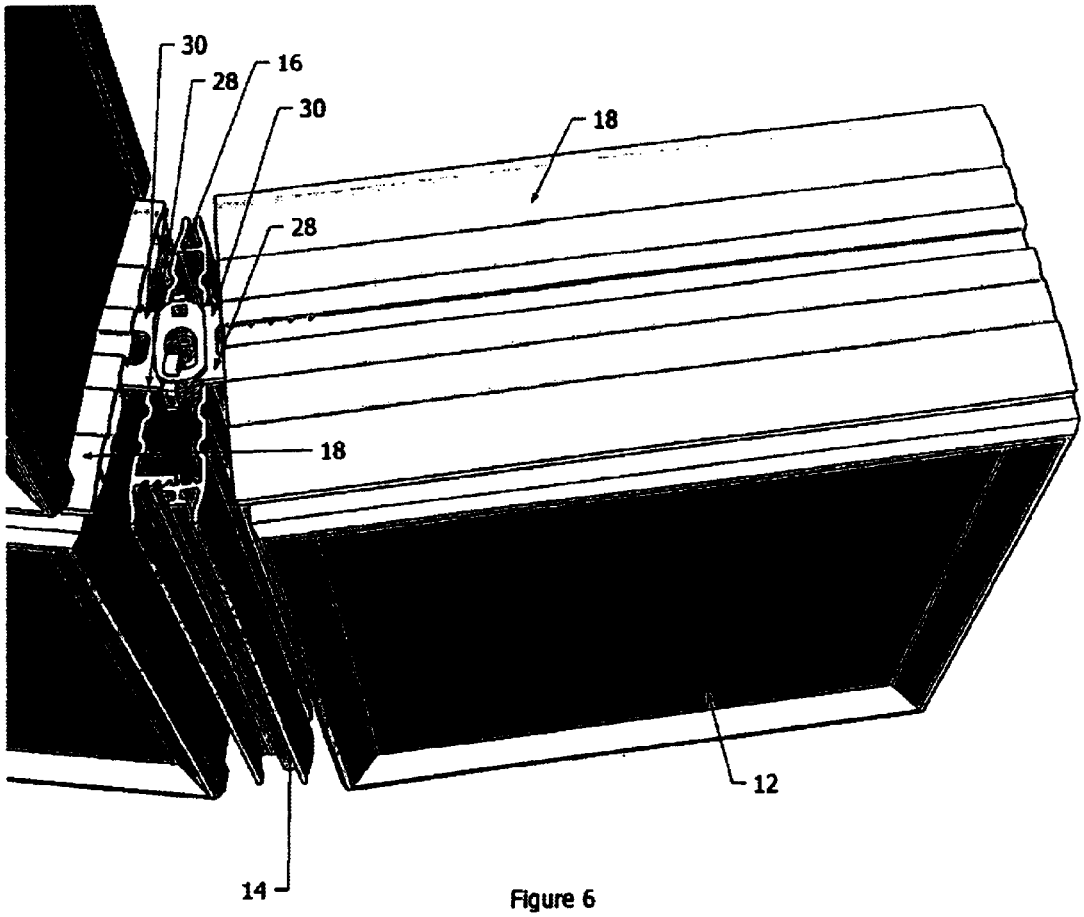
FIG. 6 is a close-up perspective view of a glass block wall joint constructed in accordance with the teachings of this invention.

Referring to FIG. 4 a perspective view of the horizontal connector 16 is shown. The horizontal connector 16 is comprised of two identical pieces 24*a* and 24*b*. Referring to FIG. 5 a perspective view of one of the pieces 24*a* of the horizontal connector 16 is shown. As shown in FIG. 5 a piece comprises a circle 26 and a knob 32 connected to the edge of the circle 26. As shown in FIG. 6 prongs 28 and 30 are parallel and extend out from the circle 26 to engage horizontal spacers 18 such that lateral adjustments may be made. The prongs 28 and 30 include barbs 34. Although, parallel prongs 28 and 30 are illustrated any number of prongs may be used.

Referring again to FIG. 4 the pieces 24*a* and 24*b* are fitted together such that prongs are located on opposite sides and the knobs 32 are fitted between the circle 26 of opposite pieces 24*a* and 24*b*. The construction of the circle 26 and knobs 32 provide for a rotatable coupling operative to provide transverse adjustments.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to the description. It is therefore contemplated that the appended claims will cover any such modifications or embodiments as fall within the true scope of the invention.

What is claimed is:

1. A vertical spacer disposed between and spacing adjacent glass blocks, each of the glass blocks having a height of "h", said vertical spacer comprising:

(a) two planar pieces each of said planar pieces having a first edge and a second edge, said first edge opposite said second edge;

(b) said first edges joined fixedly together to provide a fixed distance between two adjacent glass blocks; and (c) said second edges joined adjustably together to provide an adjustable distance between said two adjacent glass blocks.

2. The vertical spacer according to claim 1, wherein said second edge includes:

(a) one or more ridges; and (b) one or more troughs said one or more troughs operative to engage said one or more ridges.

3. The vertical spacer according to claim 1, wherein said vertical spacer is comprised of one of: PVC, plastic or a combination thereof.

4. The vertical spacer according to claim 1, wherein said vertical spacer is substantially equal in height to said "h".

5. The vertical spacer according to claim 1, wherein said fixed distance is ⅛ of an inch.

6. The vertical spacer according to claim 1, wherein said adjustable distance is adjustable from ⅜ of an inch to ½ of an inch to ⅝ of an inch.

7. A connector connecting with first and second horizontal spacers across a vertical gap between adjacent glass blocks in a wall of glass blocks, said connector comprising:

(a) a first connector portion coupled to an end of said first spacer, the end of said first spacer being adjacent said vertical gap; and (b) a second connector portion coupled to an end of said second spacer, the end of said second spacer being opposed to the end of said first spacer, said second connector portion rotatably coupled to said first connector portion;

wherein said first and second connector portions are adjustably coupled to said ends of said first and second spacers, respectively, so as to permit adjustment of a gap between said ends of said first and second spacers.

8. The connector according to claim 7, wherein said first connector portion is coupled to said first spacer by one or more first prongs and said second connector portion is coupled to said second spacer by one or more second prongs.

9. The connector according to claim 8, wherein said first and second prongs are each two in number.

10. The connector according to claim 8, wherein said first connector portion and said second connector portion are identically shaped.

11. The connector according to claim 8, wherein said first and second prongs include barbs.

12. The connector according to claim 8, wherein said connector is comprised of one of: PVC, plastic and a combination thereof.

13. A method of forming a curved glass block wall from substantially rectangular glass blocks, comprising:

a) adjusting an adjustable vertical spacer to define a desired curvature in said curved glass block wall;

b) positioning said adjustable vertical spacer between adjacent vertical sides of adjacent glass blocks;

c) positioning horizontal spacers between adjacent horizontal sides of adjacent glass blocks; and d) connecting adjacent ones of said horizontal spacers with transversely adjustable horizontal connectors.

14. The method according to claim 13, wherein said vertical spacers are substantially equal in height to a height of said glass blocks.

15. The method according to claim 13, wherein said horizontal spacers are substantially equal in length to said glass blocks.

16. The method according to claim 13, wherein said transversely adjustable horizontal connectors are further capable of lateral adjustment within said horizontal spacers.

* * * * *